United States Patent [19]

Gerber

[11] Patent Number: 5,042,338

[45] Date of Patent: Aug. 27, 1991

[54] METHOD AND APPARATUS FOR CUTTING SLIT NOTCHES IN PATTERN PIECES CUT FROM SHEET MATERIAL

[75] Inventor: H. Joseph Gerber, West Hartford, Conn.

[73] Assignee: Gerber Garment Technology, Inc., Tolland, Conn.

[21] Appl. No.: 571,076

[22] Filed: Aug. 21, 1990

[51] Int. Cl.[5] ..... B26D 3/14; D06H 7/00

[52] U.S. Cl. ..... 83/34; 83/56; 83/76.6; 83/940

[58] Field of Search ..... 83/13, 34, 49, 56, 76.1, 83/76.6, 76.9, 936-941

[56] References Cited

U.S. PATENT DOCUMENTS

| | | | |
|---|---|---|---|
| 3,626,799 | 12/1971 | Gerber et al. | 83/102 |
| 3,766,813 | 10/1973 | Pearl | 83/56 |
| 3,838,618 | 10/1974 | Eissfeldt et al. | 83/34 |
| 4,133,233 | 1/1979 | Pearl | 83/56 |
| 4,667,553 | 5/1987 | Gerber et al. | 83/49 X |

*Primary Examiner*—Frank T. Yost

*Assistant Examiner*—Eugenia A. Jones

*Attorney, Agent, or Firm*—McCormick, Paulding & Huber

[57] ABSTRACT

In a method and apparatus for cutting a slit notch in a pattern piece during the cutting of the pattern piece from work material consisting of a single sheet or a lay-up of sheets of sheet material the slit notch is cut when a notch point is reached by the cutting tool in its cutting along the line defining the pattern piece periphery. After the slit notch is cut the tool is withdrawn from cutting engagement with the work material and returned to a point associated with a previously cut portion of the peripheral line and spaced rearwardly from the point of furthermost previous advance of the tool along the peripheral line before the cutting of the slit notch to assure the cutting of material which may shift in the vicinity of the point of furtherest advance between the tool's first and later appearance of at that point, thereby obtaining clean cutting of the pattern piece from the work material allowing it to be easily separated from the waste material.

10 Claims, 3 Drawing Sheets

METHOD AND APPARATUS FOR CUTTING SLIT NOTCHES IN PATTERN PIECES CUT FROM SHEET MATERIAL

FIELD OF THE INVENTION

This invention relates to a method and apparatus for cutting pattern pieces from sheet material, such as fabrics for making clothing, upholstery or the like, spread either as a single sheet or a lay-up of sheets on a supporting surface, wherein slit notches are cut into the peripheries of the pattern pieces to serve as index marks in the subsequent sewing or other processing of the pattern pieces, and deals more particularly with improvements in such method and apparatus for assuring a complete severing or separation of the cut pattern pieces from the adjacent waste material despite the withdrawal of the cutting tool from the work material in the process of cutting each slit notch.

BACKGROUND OF THE INVENTION

The method and apparatus of this invention are ones relating to the cutting of pattern pieces from sheet material by means of a cutting tool moved along lines of cut defining the peripheries pattern pieces and wherein as the cutting tool is moved along such a peripheral line progress along the peripheral line is interrupted for the cutting of a slit notch with the tool being withdrawn from cutting engagement with the material as part of such slit notch cutting before being returned to the cutting of the peripheral line.

After pattern pieces are cut from sheet material they are removed either by hand or by machine from the adjacent waste material. To allow an efficient separation it is quite important that the pattern pieces be cleanly cut from the waste material and that no uncut strings, threads or connecting bridges exist between the pieces and the waste material. If such uncut features exist the involved pattern pieces may fail to be removed or expensive time consuminq additional manual steps may have to be performed to complete the separation. One way to eliminate, or at least reduce, this problem is to cut each pattern piece with a single complete movement of the cutting tool along the periphery of each pattern piece without removing it from start to finish from cutting engagement With the material. If the periphery of a pattern piece includes a sharp corner it is known, to avoid uncut threads and as described in U.S. Pat. No. 4,133,233, to cause the tool as it approaches the corner point to overcut, that is to cut beyond the corner point, before being withdrawn from the material, rotated and brought back to the corner point for further cutting along the peripheral line away from the corner point.

Slit notches may be cut in pattern pieces in various different ways as shown for example by U.S. Pat. No. 3,626,799; 3,766,813 and 1,667,553. In methods and apparatus shown by these patents clean cutting problems arising from slit notches are avoided by either cutting the notches after the peripheries of the pattern pieces have been gully cut or by non-withdrawal of the cutting tool during the cutting of a notch. The present invention, however, relates to situation where a notch is cut by the same knife as used to cut the periphery of a pattern piece with the notch being cut immediately upon the tool reaching a notch point during the cutting of the peripheral line and with the tool being withdrawn from cutting engagement with the material before returning to cutting of the peripheral line. The cutting tool is moved along the peripheral line of cut in cutting engagement with the material until reaching the point at which the slit is to occur. The tool is then moved inwardly in cutting engagement with the material relative to the pattern piece from the peripheral line of cut until reaching the inner end point of the slit. The tool is then withdrawn from cutting engagement with the work material and returned to coincidence with an already cut portion of the peripheral line near the notch point and then again moved forwardly along the peripheral line of cut. During cutting the tool exert forces on the material tending to displace or distort it from its neutral condition. When the tool is withdrawn from cutting engagement with the material, the material relaxes. Therefore, when the tool returns to the peripheral line the now relaxed material is likely to have a slightly different disposition on the supporting surface than when the tool first arrived at the notch point with the result that some threads or portions of the material may remain uncut as the cutting tool moves forwardly from the slit point along the peripheral line of cut if the tool is returned to cutting engagement with the material at exactly the notch point, as has heretofore been the case.

If the cutting tool is a knife reciprocated along an axis extending generally perpendicularly to the material being cut, such knife generally has a sharpened forward cutting edge, an unsharpened rear edge parallel to the forward edge and an inclined sharpened lower edge terminating in a lowermost point. The lowermost point may be either in line with the rear edge or in line with the sharpened forward edge depending on the direction of inclination of the sharpened lower edge. If the lowermost tip of the knife is in line with the rear edge the sharpened lower edge tends to generally face forwardly toward the uncut material as the knife is advanced forwardly along the line of cut. The force exerted on the material by the knife also tends to push the material forwardly. If the knife is withdrawn from the material the material tends to relax rearwardly. If the knife is now immediately returned to the material the generally forwardly facing inclined lower edge of the knife will tend to engage and cleanly cut the rearwardly displaced material since the inclined lower edge pushes such material forwardly against the adjacent body of uncut material to achieve a good cutting action. On the other hand, if the lower point of the knife is in alignment with the forward cutting edge the inclined lower sharpened edge faces generally rearwardly relative to the line of cut. If this blade is removed and re-inserted into the material during a cutting operation the portion of the material which relaxes rearwardly during the removal of the knife is, after re-insertion of the knife, engaged by the rearwardly facing lower inclined surface which tends to urge the material it engages rearwardly toward the already cut portion of the line. Therefore, there is no back-up material tending to resist rearward movement of the relaxed material with the result that such relaxed material may not be completely cut, particularly if he inclined lower edge of the knife is somewhat dull.

The general object of the invention is therefore to provide a method and apparatus for overcoming clean cutting problems of the type mentioned above arising from the Withdrawal of the cutting tool from the material when cutting slit notches in a pattern piece during the course of cutting the pattern piece periphery.

A more particular object of the invention is to provide a method and apparatus for eliminating or reducing clean cutting problems arising from slit notch cutting of the type referred to above regardless of whether the cutting tool is a knife with a generally forwardly facing lower edge or a knife with a generally rearwardly facing lower edge.

Other objects and advantages of the invention will be apparent from the following detailed description of a preferred embodiment and from the accompanying drawings and claims.

SUMMARY OF THE INVENTION

The invention resides in a method and apparatus for cutting slit notches in pattern pieces cut from sheet material wherein during the cutting of the periphery of a pattern piece the tool is moved forwardly along the peripheral line from a point A on the line to a point B on the line coinciding with the beginning of a slit notch. The notch is then cut by moving the tool from point B along the slit line with the peripheral line possibly first being overcut a small distance beyond point B before the cutting of the slit. The tool is then withdrawn from cutting engagement with the work material and is moved to a point C coinciding with an already cut portion of the peripheral line and in the vicinity of the point B. Then the tool is again moved into cutting engagement with the work material and moved forwardly along the peripheral line of cut to cut away from the point C, this resulting in a retracing or re-cutting of a portion of the peripheral line in the vicinity of the notch. This assures cutting of material displaced rearwardly from such the tool's previous point of furtherest advance along the peripheral line prior to the cutting of he notch by the relaxing of the material. It further assures clean cutting by promoting movement of the tool to the already cut line portion in the event the tool is displaced slightly laterally from such already cut line portion when returned to cutting along the peripheral line.

The invention also resides in other features of the method and apparatus defined by the appended claims.

DESCRIPTION OF THE PREFERRED EMBODIMENTS

The method and apparatus of this invention are useful in the cutting of sheet material and are applicable to various different kinds of cutting tools and cutting machines. For example, the cutting tool used for performing the actual cutting operation may be a reciprocation knife, an ultrasonically vibrated knife, a rotatable knife, a laser beam or a water jet. The cutting machine of which the cutting tool is a part may also, for example, be one wherein the cutting tool is moved either semi-automatically or automatically along lines of cut by a computer implemented control system using instructions derived from a set of marker data or other input da a describing in X and Y coordinates the shape and arrangement of pattern pieces wanted from the sheet material. The machine may also be one having a cutting station, over which the cutting tool is moveable, large enough to accommodate the largest size sheet or lay-up of sheet material brought to the cutting station, so that each such sheet or lay-up can be cut in its entirety without moving it relative to the cutting station, or the machine car be one wherein the cutting station is of smaller length than the work material to be cut so that the work material is cut in successive segments or bites.

Figure 1:
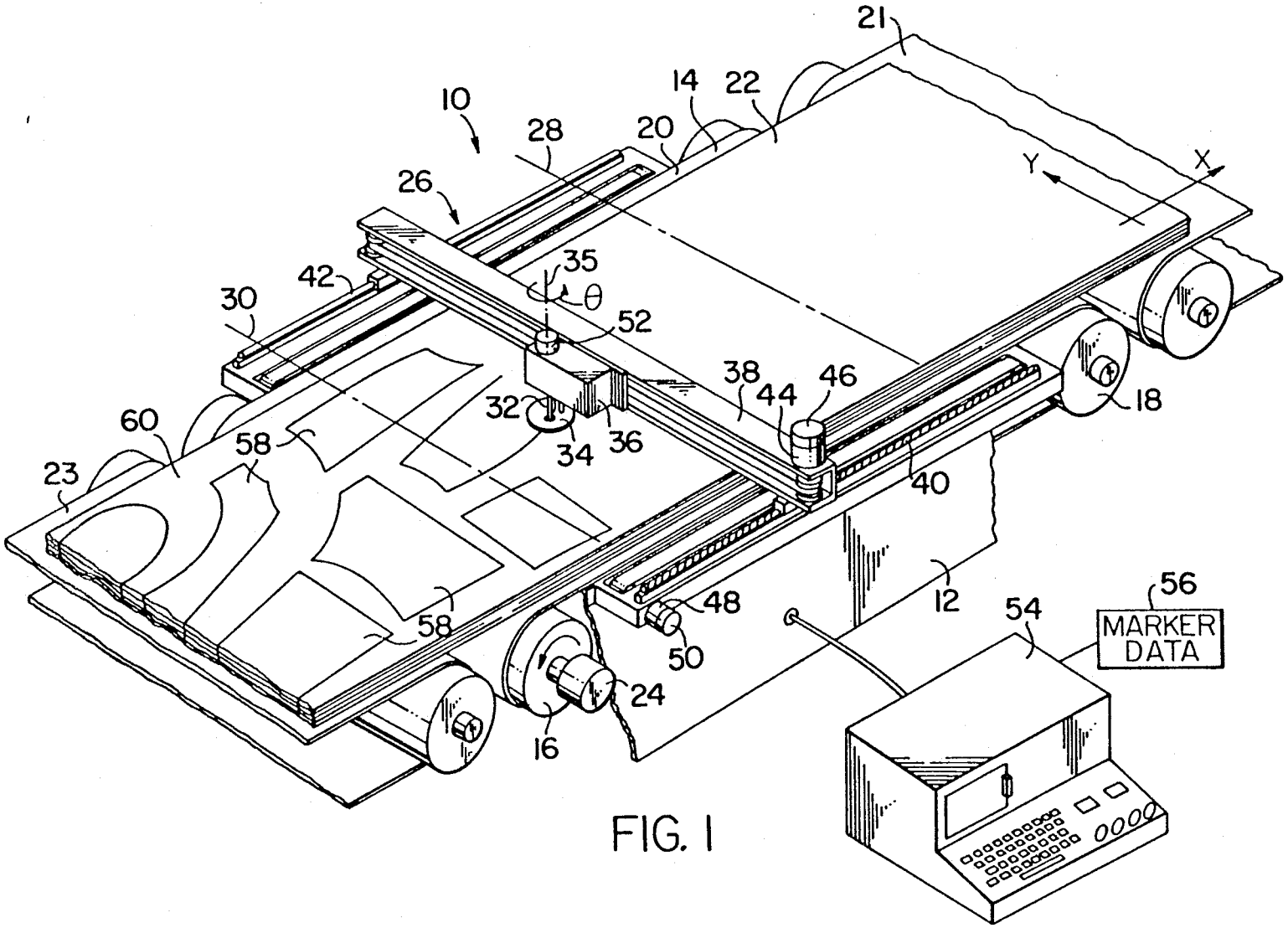
FIG. 1 is a perspective, somewhat schematic view of a cutting machine embodying the present invention.

For the purposes of this discussion, the invention is shown and described herein as embodied in an automatically controlled cutting machine of the type having a cutting station of shorter length than the material to be cut and having a conveyor for supporting the work material at the cutting station and for moving it lengthwise relative to the cutting station to bring successive segments of the material to the cutting station. Referring to FIG. 1, such machine is illustrated somewhat schematically at 10 and comprises a stationary frame 12 and an endless belt-like conveyor member 14 trained about rolls 16 and 18. The conveyor member 14 may for example be of the type shown in U.S. Pat. No. 4,328,723 wherein the member is made up of a large number of transversely extending bristle block carrying grids or slats pivotally connected to one another and wherein the rolls 16 and 18 are of suitable sprocket-like shape for positive driving cooperation with the conveyor member. In any event, the conveyor member 14 provides, along its upper run, an upwardly facing supporting surface 20 for supporting work material 22 shown as a lay-up of a number of superimposed sheets of sheet material. The forward roll 16 is powered by a drive motor 24 which rotates the roll in the counter-clockwise direction illustrated by the arrow to move the work material 22 along the illustrated X coordinate axis or toward the left as viewed in FIG. 1.

Various different means may be used with the machine 10 for assisting in bringing work material to and taking it from the cutting station 26. In the illustrated case of FIG. 1 these means include a feed conveyor 21 and a take-away conveyor 23 which may be of types well known in the art and which may be driven in unison with the conveyor member 14. In the alternative, the illustrated conveyor member 14 may be lengthened at either or both ends of the machine 10 to take the place of the separate feed conveyor 21 and/or the take-away conveyor 23.

The machine 10 includes a cutting station, indicated generally at 26, the effective range of which in the X coordinate direction is defined by the limit lines 28 and 30, and which has a range in the Y coordinate direction approximately equal to the width of the conveyor member 4. At the cutting station is a cutting tool 32 moveable in the X and Y coordinate directions over the full area of the cutting station to cut lines in the segment of work material positioned at the cutting station.

In the illustrated case the cutting tool 32 is a reciprocating knife, described in more detail hereinafter, cooperating with a presser foot 34 and reciprocated along an axis 35 of reciprocation and $\theta$ rotation extending generally perpendicularly to the plane of the supporting surface 20. The knife and the presser foot are carried by a cutter head 36, which cutter head in turn is carried by a main carriage 38 for movement relative to the main carriage in the illustrated Y coordinate direction. The main carriage straddles the conveyor member 14 and at each of its opposite ends is supported by suitable longitudinally extending guides 40, 42 for movement in the X coordinate direction relative to the frame 12. A Y drive means including a motor 44 and a Y encoder 46 drives the cutter head 36 in the Y coordinate direction relative to the main carriage 38; and an X drive means including a motor 48 and an X encoder 50 drives the main carriage 38 in the X coordinate direction. A reciprocating motor (not shown) in the cutter head drives the cutting tool 32 in its reciprocating motion, and another motor 33 (FIG. 6 rotates the cutting tool. Under control of the controller 50, about the axis 35 to keep the tool facing forward along the line of cut. A solenoid 52 carried by the cutter head 36 is operable to move the cutter head frame 74 (FIG. 6), and therewith the cutting tool 32 and the presser foot 34, between a lowered position at which the cutter tool is in cutting engagement with the material 22 and a raised position at which the tool is out of cutting engagement with the material 22.

The machine 10 is controlled by a computer implemented controller 54 which supplies the necessary commands to the machine to operate X and Y motors 48 and 44, the solenoid 52 and other parts so that the tool 32 is moved along desired lines of cut relative to the work material positioned at the cutting station 26. The control commands supplied by the controller 54 are in turn generated in response to marker data, indicated representationally at 56 describing in terms of X and Y coordinates the shape and arrangement of pattern pieces 58 to be cut from the Work material. A method and system for producing such marker data is, for example, described in U.S. Pat. No. 3,887,903. The data may he supplied either on line directly to a memory in the controller 54 or may be supplied to the controller prerecorded on a tape, disc or other memory medium In the operation of the machine 10, after a segment of the work material is positioned at the work station 26 the cutting tool is moved in the X and Y coordinate directions to cut lines in such segment, such lines usually being the peripheries of desired pattern pieces 58. After the segment is fully cut the cutting operation is interrupted, the drive motor 24 is operated to bring the next succeeding segment of work material to the work station and then the cutting tool 32 is operated again to cut lines in the fresh segment. Such segment-by-segment cutting is continued until all of the desired pattern pieces have been cut.

As explained previously following the cutting of pattern pieces by the cutting tool 32 the pattern pieces are removed from the adjacent waste material 60 either by picking up the cut pattern pieces by hand or by using a mechanical separating means. To facilitate this separation it is essential that the pattern pieces he cleanly cut and separated from the waste material with there being no uncut fibers, strings or bridges connecting the pattern pieces to the waste material.

Figure 2:
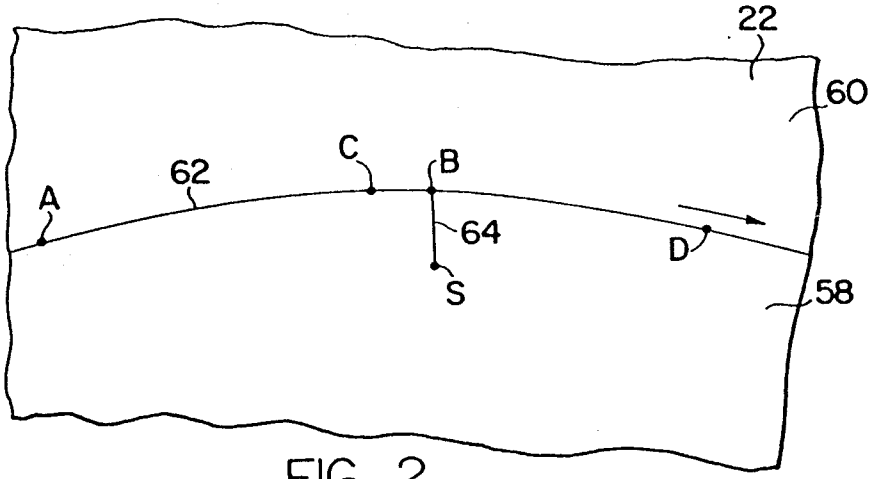
FIG. 2 is a fragmentary plan view of a portion of sheet material cut by the machine of FIG. 1 and illustrating one embodiment of the method of the invention.

One situation in which non-clean cutting often occurs is where the cutting tool is withdrawn from the work material as a consequence of the cutting of a slit notch which is cut immediately upon the tool reaching a notch point during the advancement along the peripheral line. Such a situation occurs, for example, as shown in FIG. 2, when cutting a slit notch in the peripheral edge of a pattern piece 58. In FIG. 2 the peripheral line of cut, which defines the periphery of the pattern piece, is indicated at 62 and the line defining the slit notch is indicated at 64. It is conventional when cutting such a slit notch to move the cutting tool while in cutting engagement with the material forwardly along the line 62, in the direction of the arrow, from the point A to the point B. The tool is then rotated while still in the material 22 and moved along the line 64 to the point S. The tool is then withdrawn from the material, returned to the point B, reoriented to tangency with the main line 62 (if the tool is a knife or other tool having a significant width or front to rear dimension), returned into cutting engagement with the material at the point B, and then moved forwardly again toward the point D to continue cutting the main line 62.

As a knife or other cutting tool moves forwardly while in cutting engagement with the material it exerts a forward force on the material tending to forwardly compress and otherwise distort the material from its neutral position. When the tool is withdrawn from cutting engagement the material relaxes and tends to resume its neutral undistorted shape. As a result of this, when the tool is withdrawn at the point B, due to the ensuing relaxation of the material some uncut material tends to move rearwardly of the point B. Therefore, when the tool is re-inserted at the point B it is possible that some of this previously uncut material may not be cut.

Figure 4:
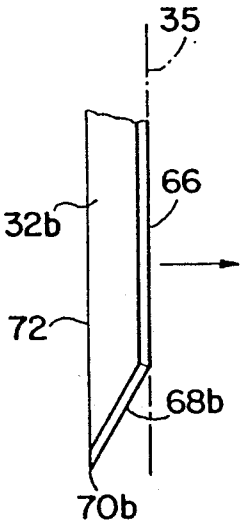
FIG. 4 is a side view of the lower end of another cutting blade usable with the machine of FIG. 1.
Figure 3:
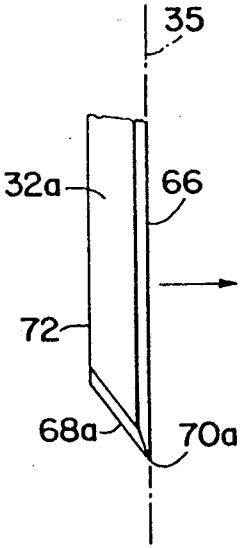
FIG. 3 is a side view of the lower end of a cutting blade usable with the machine of FIG. 1.

When the cutting tool is a knife, its shape has some influence on its ability to cut the relaxed material after being returned to a withdrawal point. For example, the knife 32 often has a shape either such as that of the knife **32*a* of FIG. 3 or that of the knife 32*b* of FIG. 4. In both of these figures the arrows indicate the direction of forward movement of the blade and the axis 35 is its axis of reciprocation. The blade 32*a* of FIG. 3 has a sharpened forward edge 66 and an inclined lower cutting edge 68*a* which faces generally rearwardly relative to the direction of forward movement of the blade so that the lowermost tip 70*a* of the blade is in alignment with the forward cutting edge 66. On the other hand, the blade 32*b* of FIG. 4 has a sharpened forward cutting edge 66 and a sharpened lower cutting edge 68*b* inclined to face generally forwardly relative to the direction of movement of the blade so that the lowermost tip 70*b* of the blade is located in alignment with the rear edge 72 of the blade. If the blade 32*b* of FIG. 4 is reinserted at a point of previous withdrawal the lower cutting edge 68*b* it encounters any relaxed uncut material and tends to push such material forwardly against a mass of other uncut material so that the relaxed material becomes pressed with some force against the sharpened edge and is likely to be properly cut. Though the blade 32*b* does not tend to leave uncut fibers, it must penetrate more deeply in the supporting surface 20 than does the blade 32*a* of FIG. 3, in order to keep the forward cutting edge 66 of the blade from lifting above the supporting surface 20 while cutting. In some circumstances this can reduce the effective life of the supporting surface 20. On the other hand, when the blade 32*a* of FIG. 3 is reinserted at a point of previous withdrawal, if the lower cutting edge 68*a* engages uncut relaxed material it tends to push such material rearwardly toward the already cut portion of the line. Therefore, no mass of other uncut material backs up the relaxed material with the result that the relaxed material may be merely pushed rearwardly by the edge 68***a* without being cut, particularly if the edge is somewhat dull.

Figure 7:
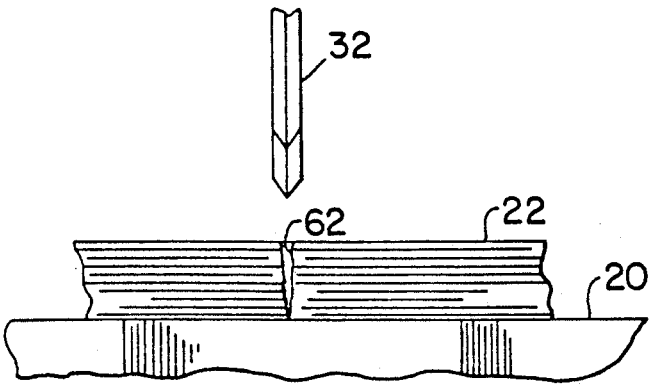
FIG. 7 is a fragmentary vertical sectional view showing the cutting tool of the machine of FIG. 1 positioned above an already cut portion of a line cut in the work material.

Returning to FIG. 2 in accordance with the invention, the possibility of obtaining a non-clean cutting when moving the cutting tool out of and back into cutting engagement with the work material is avoided, or at least almost entirely reduced, by moving the cutting tool so that when brought back into cutting engagement with the material such re-engagement occurs at a point located along an already cut portion of the peripheral line 62 in the vicinity of the notch point B. In the illustrated case of FIG. 2 the tool upon first reaching the notch point B is immediately, without overcutting, moved along the slit line and the point C is spaced rearwardly along the peripheral line 62 a substantial distance from the point B. That is, as shown in FIG. 2, the cutting tool is re-engaged with the work material at a point C located between the points A and B on the peripheral line 62. The point C is thus located rearwardly of the notch point B, which represents the point of furtherest previous tool advance along the line 62, and the point C is therefore on a portion of the line 62 already cut by the cutting tool before being withdrawn from the material. The point C is spaced rearwardly from the point B by a distance sufficient to cause it to be located behind any uncut material which may move rearwardly beyond the point B by relaxation of the work material. The exact amount of the spacing can be a preset fixed amount used in all instances or can be an amount which is software configurable and variable depending on various cutting parameters. Preferably the spacing is within a range of 1/16 inch to 1 inch and more preferably is approximately ½ inch. The backspacing itself is software configurable. That is, when the cutting tool is to be re-engaged with the work material at a point spaced rearwardly from the point of furtherest previous advance of the program used by the controller 54 automatically calculates the appropriate location of the point C and causes the tool to be moved to that point and re-engaged with the material. It should also be observed that if due to shifting of the material or other errors the cutting tool when re-engaged with the material at the point C is slightly displaced to one side or another of the already cut line the cutter will tend to drift toward the already cut line when moved forwardly so as to move into the already cut line before engaging any uncut material relaxed rearwardly from the point B. Also, as shown in FIG. 7 the knife 32 has a tapered lower end which aids the knife in moving into the already cut portion of the line 62, or the knife is moved downward into cutting engagement with the material 22, if the knife is slightly displaced to one side or the other of the line 62 before start of its downward movement.

Figure 5:
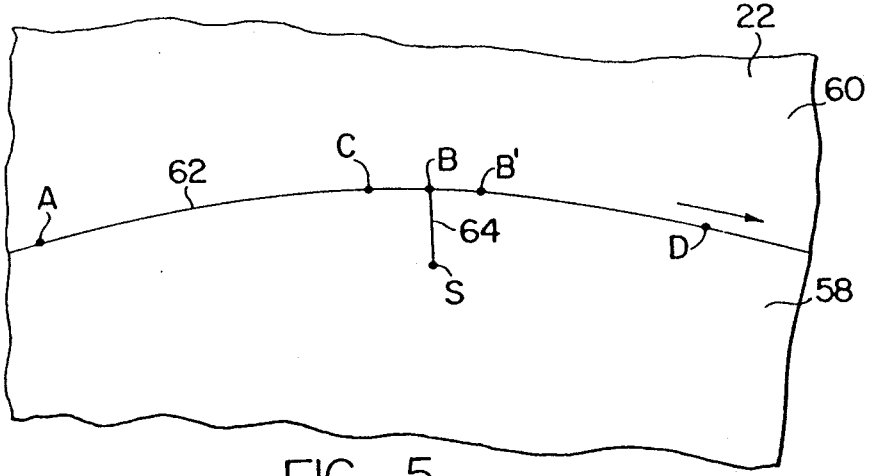
FIG. 5 is a view similar to FIG. 2 but illustrates another embodiment of the method of the invention.

FIG. 5 illustrates another method embodying the invention for cutting a slit notch in the work material. As shown in this figure, in the cutting of the peripheral line 62 the cutting tool is moved forwardly along the line 62 in cutting engagement with the material 22 until reaching the notch point B marking the location of the desired slit notch as defined by the slit line 64. Upon reaching the point B the tool is moved a short distance forwardly beyond the point B along the peripheral line 62 to the point B′ to provide a forwardly extending overcut. The tool is then returned to the point B and the slit line 64 is cut by moving the tool from the point B to the point S. The return of the tool from the point B′ to the point B may be accomplished with or without withdrawal of the tool at the point B′, but preferably the tool is merely backed up along the line 62 from the point B′ to the point B without being withdrawn from cutting engagement with the material, and the slit line 61 then immediately cut without withdrawing the tool from cutting engagement with the material until reaching the point S. Then, the tool is returned to the point C located along previously cut portion of the peripheral line 62, is brought back into cutting engagement with the material 22 and is then moved forwardly along the line 62 to and beyond the point D.

In the illustrated case of FIG. 5 the reentry point C is located rearwardly of the point B along the line 62 so as to fall between the points A and B. However, if the point B′ of furtherest tool advance prior to the cutting of the slit line 64 is located sufficiently forwardly of the notch point B the reentry point C may be coincident with the point B or may even be located forwardly of the point B so as to fall between the point B and the point B′. As in the case of FIG. 2, the point C is, however, preferably spaced rearwardly from the point of furtherest advance (point B in FIG. 2 and point B′ in FIG. 5) by a distance falling within the range of 1/6 inch to 1 inch and more preferably by a distance of approximately ½ inch.

Figure 6:
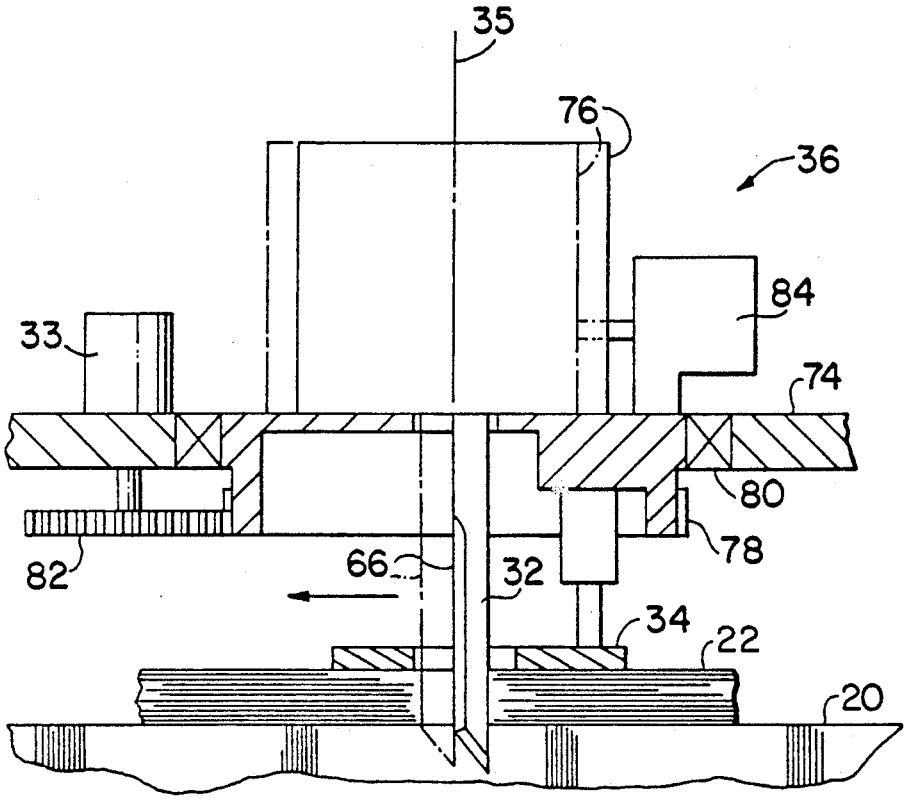
FIG. 6 is a vertical sectional view through the cutter of FIG. 1.

In practicing the cutting method illustrated in FIG. 5 the overcutting of the peripheral line at a notch point B may be accomplished in various different ways. For example, the program controlling the motion of the cutter head along the peripheral line 62 may be such as to cause continued movement of the cutter head beyond the notch point and along the peripheral line as required to execute the overcut. On the other hand, the overcut may also be achieved by stopping the movement of the cutter head frame when reaching the notch point B and then moving the cutting tool forwardly relative to the cutter head frame while the frame is held stationary relative to the material 22. An apparatus for doing this is shown in FIG. 6 wherein the cutter head 36 is shown as having a frame 74 moved in X and Y coordinate directions with the main portion of the cutter head 36. The knife reciprocating mechanism 76 is mounted on a generally cylindrical member 78 supported by a bearing 80 for rotation about the axis 35 by the motor 33 which drivingly engages the member 78 through a gear 82. The reciprocating mechanism 76 is supported on the member 78 for back and forth movement parallel to the front and rear direction of the knife 32 between the solid and broken line positions shown in FIG. 6. A solenoid 84 carried by the member 78 is operable to move the reciprocating mechanism 76 and the attached knife 32 relative to the member 78 between the illustrated back and forth positions. Normally the reciprocating mechanism 76 is positioned as shown by the solid lines of FIG. 6 and, with reference to FIG. 5, it takes this position when cutting along the peripheral line 62 from the point A to the point B. When the point B is reached the movement of the cutter head frame 74 along the line 62 is stopped and the frame is held stationary relative to the material 22. The solenoid 84 is then operated to shift the reciprocating mechanism 76 and knife 32 forwardly to the broken line positions of FIG. 6, causing the knife 32 to cut from the point B to the point B′ of FIG. 5. The solenoid 84 is then conditioned to return the reciprocating mechanism 76 to its normal full line position before the knife 32 is returned to cutting engagement with the material 22 at the point C.

I claim:

1. A method of cutting a slit notch in a pattern piece during cutting of the pattern piece from work material consisting of at least one sheet of sheet material, said method comprising the steps of:

spreading the work material on a supporting surface, defining a peripheral line of the pattern piece to be cut from said work material, moving a cutting tool forwardly along said peripheral line while in cutting engagement with said work material from a point A on said line to a notch point B on said line coinciding with the beginning of a slit notch departing from said peripheral line and extending into said pattern piece, after said cutting tool reaches said notch point B moving said tool from point B away from said peripheral line to cut said slit notch, after cutting said slit notch withdrawing said tool from cutting engagement with said material, repositioning said tool to a point C coinciding with an already cut portion of said peripheral line in the vicinity of point B, bringing said tool back into cutting engagement with said material, and then moving said tool in cutting engagement with said material along said peripheral line forwardly from point C.

2. A method of cutting work material as defined in claim 1 further including:

said cutting tool being a knife reciprocated along an axis of reciprocation extending generally perpendicularly to said supporting surface while in cutting engagement with said work material.

3. A method of cutting work material as defined in claim 2 further including:

said point C being spaced rearwardly from the point of furtherest previous advance of said knife along said peripheral line by a distance of between 1/16 inch and 1 inch.

4. A method of cutting work material as defined in claim 3 further including:

said point C being spaced rearwardly from said point of furtherest previous advance by a distance of approximately ½ inch.

5. A method of cutting work material as defined in claim 1 further characterized by:

said tool when first reaching said notch point B being immediately moved away from said peripheral line to cut said slit notch, and said point C being located rearwardly along said peripheral line from said point B.

6. A method of cutting work material as defined in claim 1 further including, after first reaching said notch point B with said cutting tool moving said cutting tool in cutting engagement with said material a slight distance forwardly along said peripheral line from said notch point B to a point B. before cutting said slit notch.

7. A method of cutting work material as defined in claim 6 and further including:

said point C being located rearwardly along said peripheral line from said point B.

8. A method of cutting work material as defined in claim 6 and further including:

said point C being coincident with said point B.

9. A method of cutting work material as defined in claim 6 further including:

said point C being located between said points B and B'.

10. A method of cutting work material as defined in claim 6 and further including:

said cutting tool being part of a cutting head having a frame carrying said cutting tool, said step of moving said cutting tool forwardly along said peripheral line while in cutting engagement with said work material from a point A on said line to a point B on said line being accomplished by moving said cutter head frame along said peripheral line, and said step of moving said cutting tool forwardly along said peripheral line a slight distance beyond said notch point B being accomplished by moving said cutting tool forwardly relative to said cutter head frame while said cutter head frame is held stationary relative to said work material.

* * * * *